US006471634B1

(12) United States Patent
Dykes et al.

(10) Patent No.: US 6,471,634 B1
(45) Date of Patent: Oct. 29, 2002

(54) INFANT CARE APPARATUS WITH BIDIRECTIONAL SLIDING DRAWER

(75) Inventors: Christopher A. Dykes; Thomas C. Jones, both of Columbia, MD (US)

(73) Assignee: Datex-Ohmeda, Inc., Madison, WI (US)

( * ) Notice: Subject to any disclaimer, the term of this patent is extended or adjusted under 35 U.S.C. 154(b) by 0 days.

(21) Appl. No.: 09/503,072

(22) Filed: Feb. 12, 2000

Related U.S. Application Data

(60) Provisional application No. 60/170,276, filed on Dec. 11, 1999.

(51) Int. Cl.[7] ..... A61G 11/00
(52) U.S. Cl. ..... 600/22
(58) Field of Search ..... 600/21–22

(56) References Cited

U.S. PATENT DOCUMENTS 4,936,824 A 6/1990 Koch et al.
5,474,517 A 12/1995 Falk et al.
5,898,817 A * 4/1999 Salmon et al. ..... 600/222
5,980,449 A * 11/1999 Benson et al. ..... 600/222

FOREIGN PATENT DOCUMENTS

DE 3544301 A1 12/1985

* cited by examiner

*Primary Examiner*—John P. Lacyk
(74) *Attorney, Agent, or Firm*—Roger M. Rathbun

(57) ABSTRACT

An infant care apparatus is provided that includes an infant support for underlying the infant. A drawer is provided beneath the infant support and which has a center position where it is generally aligned with the infant support and which is movable bidirectionally from that center position so that it can be moved in either direction. Thus, the caregiver can sit at either lateral side of the infant care apparatus and be positioned close to that apparatus and have room for the knees by pushing the drawer out of the way. In addition, the base is configured to have generally C-shaped base members having ends that extent outwardly to provide stability for the apparatus but allow a chair to be positioned next to the infant care apparatus without hitting or being obstructed by the base.

9 Claims, 3 Drawing Sheets

INFANT CARE APPARATUS WITH BIDIRECTIONAL SLIDING DRAWER

RELATED CASES

The present application is based upon Provisional Patent Application, Ser. No. 60/170,276, filed Dec. 11, 1999.

BACKGROUND

The present invention relates to an infant care apparatus and, more particularly, to an apparatus for providing facilities for the care of an infant and having a bidirectional sliding storage drawer.

There are, of course, many devices or apparatus for the care of an infant and, among such differing such apparatus, there are infant incubators and which are confined enclosures that contain the infant within an enclosed controlled atmosphere that provides heat to the infant and also may provide control of humidity in the enclosed environment. The infant itself is positioned upon a flat, planar surface atop an infant platform. Generally the infant platform forms the base of an infant compartment that encloses the infant in a controlled environment and the infant compartment further is enclosed by transparent side walls and a cover to fully enclose that infant compartment. Such incubators maintain the infant for long periods of time and it is often necessary for the caregiver to have extended continual access to the infant within the apparatus and therefore may sit alongside the infant care apparatus to carry out some prolonged procedure on the infant.

As a further typical feature on such infant care incubators, there is always a need for storage space to contain and keep near at hand the numerous items needed to properly carry out the care of the infant. Due to the limited space in most nurseries in hospitals, it is most convenient to provide the infant care apparatus with a close at hand storage facility that is easy to access and which can have sufficient space to contain the necessary articles ready for the caregiver.

As such, typically, while it is convenient to provide a drawer in the infant apparatus, the location of such a drawer creates other problems. With infant care apparatus, it is necessary to have the infant positioned at a convenient height for the caregiver to access the infant. Generally beneath the platform on which the infant rests, there is also normally a compartment that houses the convective heating system comprising a heater, fan and the various ducting to move the heated air to and from an infant compartment. Thus, for a drawer to be added to the apparatus, its position inherently is beneath the convective heating compartment and is thus positioned relatively low within the apparatus.

Accordingly, when the infant caregiver attempts to sit in a chair next to the infant care apparatus along either lateral side thereof, where there is the best access to the infant, the caregiver is unable to get close to the apparatus as the knees of the caregiver encounter the drawer and thus the caregiver cannot get a comfortable seated position near to the infant to enable good access to the infant.

As a further problem to the caregiver being able to sit adjacent the lateral sides of the infant care apparatus, the base of the apparatus itself normally also creates an obstruction as a chair cannot be pushed close to the infant care apparatus without the logs of the chair hitting the base of the apparatus. Thus, not only is the drawer an obstruction to prevent the caregiver from sitting on a chair in close proximity to the lateral sides of the infant care apparatus, but the base of the apparatus itself is a further impediment by preventing the chair legs from being slid sufficiently underneath the apparatus to enable the caregiver to use the chair and attend to the infant.

One recognition of the problem has been stated in German Offenlegungsschrift DE 3544301 A1, where a U-shaped frame is shown that is said to allow the caregiver room to position the chair close to the incubator, however, in that publication, the incubator itself has been slanted downwardly to allow room for the persons legs and thus could not also position a convenient drawer beneath the incubator.

Also, as can be seen in the German publication, the solution to the problem is one-sided, that is, the construction allows the caregiver to sit close to the incubator on one side only and could not be adapted to allow that person to choose either side of the incubator to sit and attend to the infant. Accordingly, the solution set forth in that reference lacks versatility for the caregiver where it would be advantageous for the apparatus to allow the caregiver the option to sit close to the infant on either lateral side of the infant care apparatus.

In addition, it is extremely important that the infant care apparatus have inherent stability, that is, that R not be capable of easily being tipped and thus, it is important that the base be sufficiently wide and strong to resist tipping of the apparatus. There are difficulties in designing a base for an infant care apparatus to allow close access to a caregiver, and particularly with the use of a chair, and yet maintain good non-tipping characteristics.

Thus it would be advantageous to have an infant care apparatus that has a drawer to store equipment and supplies needed for attending to the infant and yet which drawer can be moved out of the way when the caregiver wants to be in a position seated in a chair alongside either lateral side of the infant apparatus and also have a base that allows the caregiver to place a chair sufficiently close to the apparatus to attend to the infant without being obstructed by the drawer or encountering the supporting base of the apparatus as an obstruction to placement of the chair. It would be still further advantageous to accomplish the above while retaining good non-tipping characteristics of the infant care apparatus.

SUMMARY OF THE INVENTION

Accordingly, the present invention relates to an infant care apparatus that has a base and a frame extending upwardly from the base and which has an infant platform extending outwardly, preferably in cantilever manner from the frame. The infant platform has a flat, planar surface to provide a support for positioning the infant and has lateral sides extending along the length of the infant platform and which allow the caregiver access to the full sides of the infant. A top is provided so as to fully form an infant compartment that can provide a controlled environment for the infant positioned therein.

As used in the present description, an infant incubator will be described as the preferred embodiments it being understood, however, that while the incubator is preferred for the present invention, the invention is applicable to other types of infant care apparatus, including infant warmers.

Within the infant platform, therefore, with an incubator, there is normally a heating and air moving compartment that houses the various components to provide the heat and controlled humidity to the infant positioned within the infant compartment. Such components make up a convective heating system to introduce heated air into the infant compartment and to receive air for recirculation from the infant compartment.

Located underneath the infant platform is a bidirectional sliding drawer that is used to contain objects, equipment and supplies needed for caring for the infant. The drawer has a center position where it is directly centered underneath the infant platform and thus has its lateral sides generally contiguous to the lateral sides of the infant platform. By definition herein, the lateral sides of the infant care apparatus as well as the component thereof will be the longitudinal sides of the generally rectangular infant platform, that is, the sides parallel to the longitudinal axis of the rectangular configuration and the caregiver is normally positioned along the lateral sides to enable the caregiver full access to the sides of the infant.

Accordingly, with the drawer in the center position, the drawer is closed as it is covered by the infant platform. The drawer, however, is affixed to the underside of the infant platform such that it can slide bidirectionally from that center position, that is, the drawer can slide at a right angle to its lateral sides in either direction from the center position.

As such, the caregiver can move the drawer in either direction and can thus sit at either lateral side of the infant care apparatus by simply pushing the drawer away from whichever lateral side the caregiver desires to be located in attending to the infant As an alternative construction, the drawer can be rotatably or pivotally mounted to the infant care apparatus so that it can be rotated out of a center position in either direction to allow space for the caregiver along both of the lateral sides of the infant care apparatus.

In addition, the base itself has a preferred configuration where both lateral sides of the base are formed with an inwardly displaced center section with respect to the lateral sides of the infant platform, thus, on either side of the infant care apparatus, the caregiver can move a chair into position adjacent a lateral side and the chair legs will not be obstructed by encountering the base. In the preferred embodiment, the base is formed in the shape of a pair of slightly flattened C-shaped lateral base members, joined at the center and with each having the free ends of the C-shape extending outwardly from the center toward the lateral sides of the infant platform so that there is a space on both sides of the infant care apparatus to position the legs of a chair. In addition with the generally C-shaped base members, the free ends of the C-shape configuration can extend outwardly symmetrically and sufficiently to provide a stable base and exhibit good non-tipping characteristics.

Thus, as can be seen, due to the overall configuration of the infant care apparatus, the caregiver can be positioned in a chair and sit close to either of the lateral sides of the apparatus and be near to the infant without encountering an obstacle by the knees being obstructed by the drawer or the chair legs encountering the base and yet the infant car apparatus can have a convenient drawer to store supplies with ready availability to the caregiver without sacrificing stability characteristics.

These and other features and advantages of the present invention will become more readily apparent during the following detailed description taken in conjunction with the drawings herein.

DETAILED DESCRIPTION OF THE INVENTION

Figure 1:
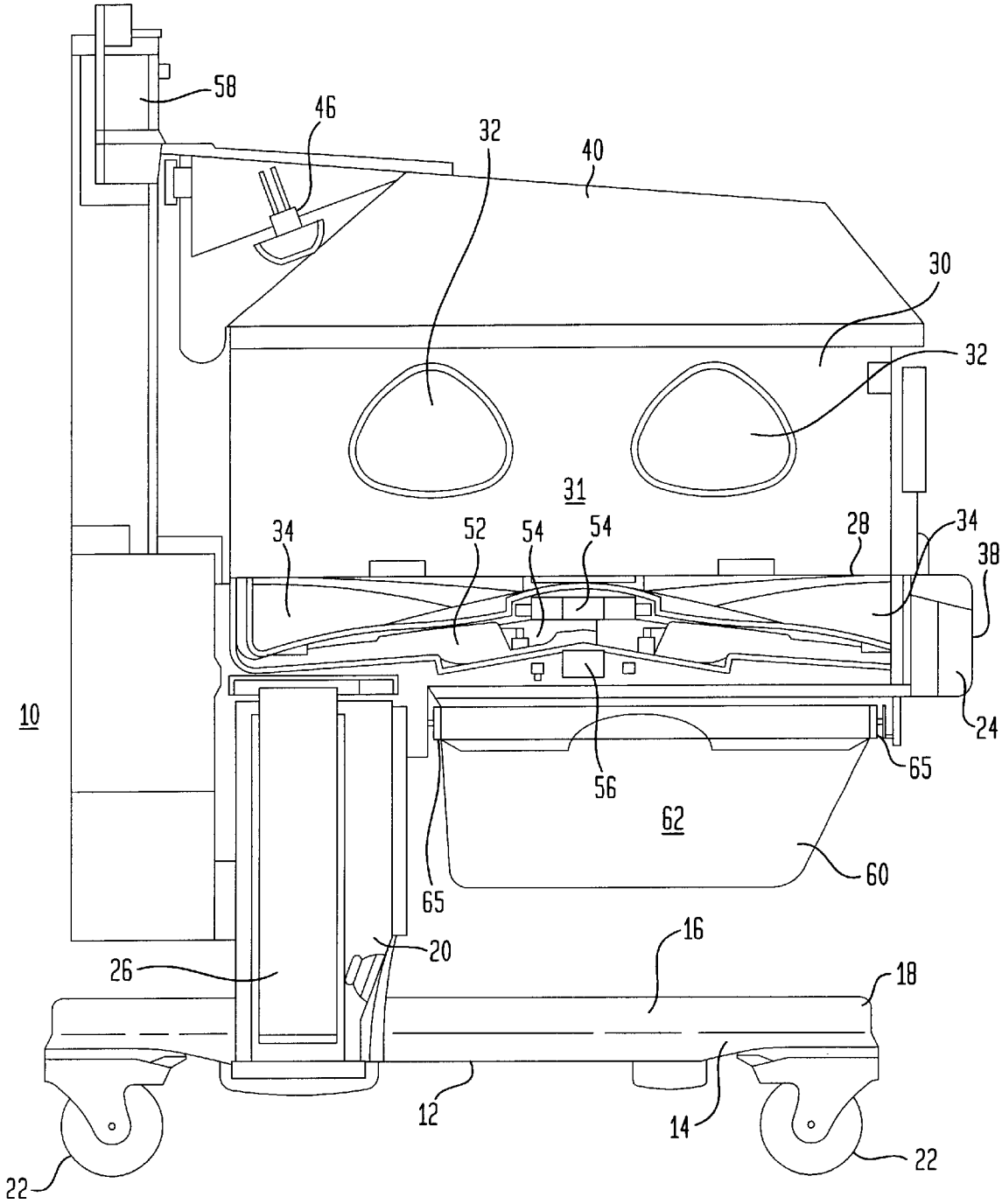
FIG. 1 is a side view, partially cut away, of an infant care apparatus incorporating the present invention.
Figure 2:
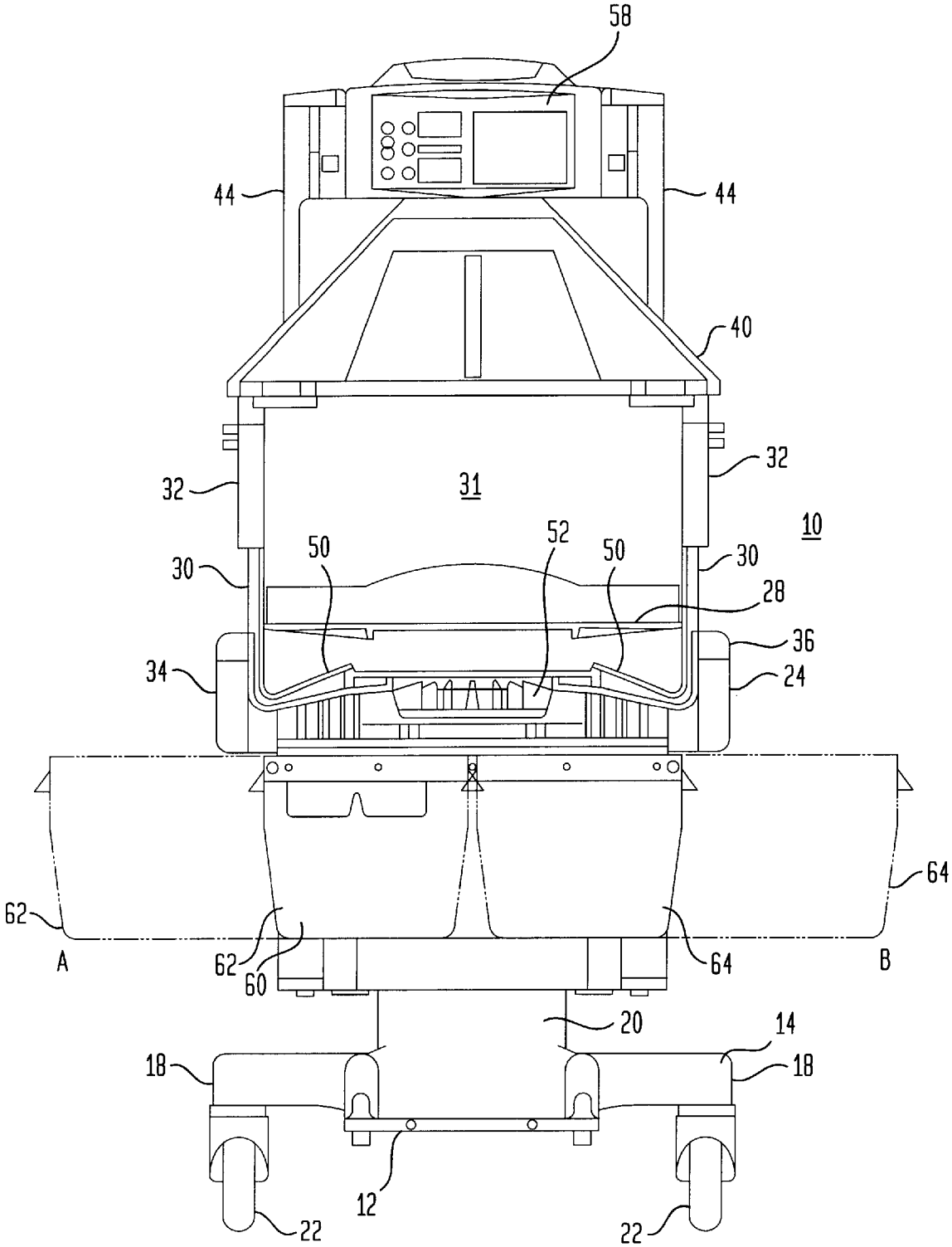
FIG. 2 is an end view, partially cut away, of the infant care apparatus of FIG. 1.
Figure 3:
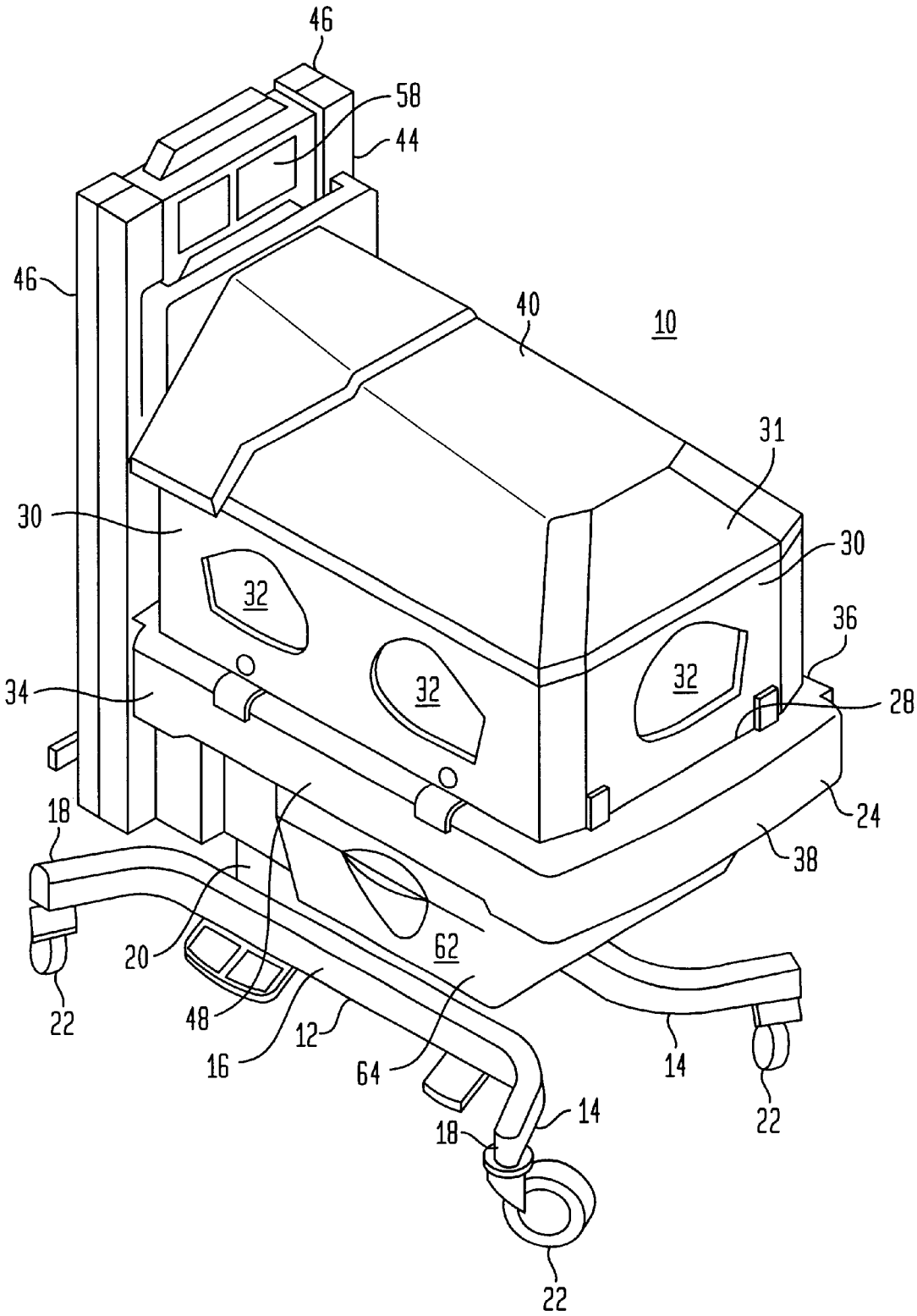
FIG. 3 is a perspective view of the infant car apparatus of FIGS. 1 and 2.

Referring now to FIG. 1, there is shown a side view of an infant care apparatus 10 constructed so as to use the present invention. Referring also to FIGS. 2 and 3, there are shown, respectively, an end view of an infant care apparatus 10 and a perspective view of the infant care apparatus of FIGS. 1 and 2.

Thus, in the Figs, the infant warming apparatus 10 includes a base 12 comprising a pair of lateral base members 14 that each have an inwardly displaced center section 16 and outer free ends 18 to provide support for a stationary vertical base member 20. Wheels 22 may also be provide for ready movement of the infant care apparatus 10. The particular configuration of the base will be later explained.

An infant platform 24 is provided and which supports an infant in the infant care apparatus 10 and the infant platform 24 may be mounted in cantilever manner to a movable vertical base member 26 in a manner such that the user can adjust the height of the infant platform 24 by raising and lowering the movable vertical base member 26 with respect to the stationary vertical base member 20 to the preferred height by the user. The infant platform 24 includes a flat, planar surface 28 that actual underlies the infant when positioned with the infant care apparatus 10.

Extending upwardly around the periphery of the infant platform 24 are a plurality of walls 30, normally of a transparent plastic material and which surround the flat planar surface 28 to form an infant compartment 31 to enclose the infant in a controlled environment. As can be seen, the walls 30 can have handholes 32 to enable the caregiver to reach the infant, however, if even more access is required to the infant, at least the lateral side walls 30 can be dropped downwardly to open fully for complete access to the infant to carry out procedures on the infant or for introducing and removing the infant from the infant care apparatus 10.

As used herein, the term lateral will refer to the sides of the infant care apparatus 10 that are the longer dimensioned of the generally rectangular configuration of the infant platform 24 as well as of the infant care apparatus 10 and are the sides that are located along the side of the infant when positioned in the apparatus. The caregiver is normally positioned along the lateral sides of the infant care apparatus 10 since that location affords the best access to the full length of an infant positioned within the infant compartment 31.

Thus, there are lateral sides 34, 36 to the infant platform 24 and an end 38. A hood 40, when in the position as shown in the Figs. covers the upper peripheral edges of the walls 30 to enclose therein the infant compartment 31 that provides a controlled environment where heat and humidity can be controlled to aid in the development and well being of the infant. The hood 40 may of a conventional design, however, in the embodiment as shown, the hood 40 can be raised and lowered vertically to cover and uncover the infant compartment 31. The raising and lowering mechanism is not part of the present invention, however a mechanism is described in detail in copending U.S. patent application Ser. No. 09/316,506 filed May 21, 1999 and entitled Lift Mechanism For Infant Care Apparatus Canopy and the disclosure of which is incorporated herein by reference.

In general, and which is sufficient for purposes of the present disclosure, the hood 40 is affixed to a movable vertical frame member 44 that moves with respect to, and interfits with stationary vertical frame members 46 and a lifting mechanism is used to move the movable vertical frame members 44 and the hood 40 upwardly and downwardly with respect to the stationary vertical frame members 44.

A radiant heater 46 can also be included for providing heat to the infant when the hood 40 is in its uppermost position and thus the infant care apparatus 10 can be operated in the manner of an infant warmer, one of which is shown and described in U.S. Pat. No. 5,474,517 of Falk et al.

A heating and air moving compartment 48 is located within the infant platform 24 beneath the flat, planar surface 28 on which the infant is positioned and within the heating and air moving compartment 48 there is located the various ducting 50 that directs the air up to within the infant compartment 31 and to receive the air from the infant compartment 31 for recirculation. Thus, within the heating and air moving compartment 48, there is a heater 52 and a fan 54 operable by a motor 56 and which heats the air to be introduced into the infant compartment 31 to provide the warmth to the infant. The heating and air moving compartment 48 can be conventional and may be similar to the apparatus shown and described in U.S. Pat. No. 4,936,824 of Koch et al.

A control module 58 is conveniently positioned intermediate the stationary vertical frame members 44 and may include displays of various monitored parameters as well as include the various controls for operation of the functions of the infant care apparatus 10.

In accordance with the present invention, a drawer 60 is positioned beneath the infant platform 24 and is slidingly affixed to the underside thereof. The drawer is used to retain supplies or other devices needed to carry out some operation or procedure on the infant. As shown in FIGS. 1 and 3, and in the solid line position of FIG. 2, the drawer 60 is in its center position, that is, the lateral sides 62, 64 of the drawer 60 are generally contiguous to the lateral sides 34,36 of the infant platform 24 and thus, in that center position, the drawer 60 is positioned directly beneath and generally in alignment with the infant platform 24.

The actual affixation of the drawer beneath the infant platform 24 may be by means of conventional tracks, such as a roller tracks 65, one of which is affixed to the vertical movable base member 26 and which supports one side of the drawer 60 and the other of which can be affixed to the underside of the infant platform 24. A typical track is similar to the use in conventional file drawers that have roller tracks and which enable the drawer 60 to be movable bidirectionally from the center position in either direction at a right angle to the lateral sides 34, 36 of the infant platform 24.

As specifically referred to in FIG. 2, there is shown in the dotted line positions, the drawer 60 moved to the position indicated A and to the position indicated B. In each instance, the drawer 60 is moved from its center position and one of its lateral sides is thus moved away from its contiguous position with respect to the corresponding lateral side of the infant platform 24 so that there is room for the knees of the caregiver underneath the infant platform 24. As can be seen, the drawer 60 is able to slide in both directions from the center position, that is, bidirectionally, so that the caregiver can sit at either lateral side of the infant platform 24 to attend to the infant and is not constrained to access the infant from only one of the lateral sides of the infant platform 24.

Thus, the caregiver can sit close to either lateral side of the infant care apparatus 10 and be close to the infant by simply sliding the drawer away from that sitting location and the knees can be positioned underneath the infant platform 24 for ready access to the infant without overextending the arms.

As a further factor in enabling the caregiver to attain such a close position is the particular configuration of the base 12. As previously described, the base includes a pair of lateral base members 14 that are similarly shaped and which both have a center section 16 that is displaced inward toward the center of the infant care apparatus 10 and the free ends 18 extend outwardly from that center. In the design of infant care apparatus, considerable attention and regulations are involved with respect to the potential of tipping of the apparatus and it is necessary that the base 12 be sufficiently strong and be sufficiently wide to insure that the infant apparatus 10 is not readily tipped. Accordingly, with the present configuration of the base 12, the free ends 18 extend outwardly to deter tipping while the inwardly recessed center sections 16 allow the chair of the caregiver to be positioned very close to the infant platform 24. As shown, the lateral base members 14 are generally C-shaped, slightly flattened, with the center of the C configuration displaced inwardly toward the center of the infant care apparatus 10.

Thus, by a combination of the specially configured base and the adaptability of the bidirectionally slideable drawer, the infant care apparatus of the present invention allows the caregiver to be positioned dose to the infant at the lateral sides of the apparatus to attend to the infant and yet there is still the convenience of a drawer to store supplies and to have such supplies at hand. In addition, the base is specially configured so as to allow the caregiver to position a chair near either lateral side of the infant care apparatus without being obstructed by encountering the base of the apparatus. Further, by the specially configured base, the infant care apparatus can provide the aforementioned features without compromising its non-tipping characteristics.

Those skilled in the art will readily recognize numerous adaptations and modifications which can be made to the infant care apparatus of the present invention which will result in improved features, yet all of which will fall within the scope and spirit of the present invention as defined in the following claims. Accordingly, the invention is to be limited only by the following claims and their equivalents.

We claim:

1. An infant care apparatus, said apparatus having a base, a frame member extending upwardly from said base, an infant platform extending outwardly from said frame member and having a longitudinal centerline, said infant platform positioned above said base and having lateral sides, said infant platform adapted to support thereon an infant, and a drawer affixed beneath said infant platform, said drawer having a center position generally directly centered underneath said infant platform, said drawer adapted to slide bidirectionally from said center position at a right angle with respect to the lateral sides of said infant platform, whereby said drawer is moved to a position inwardly with respect to either of said lateral sides of said infant platform to allow a person to sit alongside said lateral sides without encountering said drawer.

2. An infant care apparatus as defined in claim 1 wherein said base comprises a pair of C-shaped members oppositely positioned so as to have their free ends projecting outwardly toward the lateral sides of said infant care apparatus, wherein the inwardly directed center portion of said C-shaped members allow a chair to be placed beneath said infant care apparatus with encountering said base.

3. An infant care apparatus as defined in claim 1 wherein said drawer has lateral sides generally contiguous to said lateral sides of said infant platform when in said center position.

4. An infant care apparatus as defined in claim 3 wherein said base has a generally inwardly directed center section at both lateral sides of said infant care apparatus to enable a piece of furniture to be positioned beneath said infant care apparatus without encountering said base.

5. An infant incubator, said incubator having a base, a frame member extending upwardly from said base, an infant platform extending outwardly from said frame member and having a longitudinal centerline, said infant platform positioned above said base and having lateral sides, walls extending upwardly form said infant platform and having a top to form therein an infant compartment for providing a controlled environment for an infant, a heating and air moving compartment within said infant platform adapted to provide heated air for introduction into said infant compartment to heat an infant within said infant compartment, and a drawer affixed beneath said infant platform, said drawer having a center position generally directly centered underneath said infant platform and said drawer having lateral sides generally contiguous to said lateral sides of said infant platform when in said center position, said drawer adapted to slide bidirectionally from said center position at a right angle with respect to the lateral sides of said infant platform, whereby said drawer is moved to a position inwardly with respect to either of said lateral sides of said infant platform to allow a person to sit alongside said lateral sides without encountering said drawer.

6. An incubator as defined in claim 5 wherein said base comprises a pair of C-shaped members oppositely positioned so as to have their free ends projecting outwardly toward the lateral sides of said infant care apparatus, wherein the inwardly directed center portion of said C-shaped members allow a chair to be placed beneath said infant care apparatus with encountering said base.

7. An infant care apparatus, said apparatus having a base, a frame member extending upwardly from said base, an infant platform extending outwardly from said frame member and having a longitudinal centerline, said infant platform positioned above said base and having lateral sides, said infant platform adapted to support thereon an infant, and a drawer affixed beneath said infant platform, said drawer having a center position generally directly centered underneath said infant platform, said drawer adapted to move from said center position away from said center position and away from said lateral sides of said infant platform, whereby said drawer is moved to a position with respect to either of said lateral sides of said infant platform to allow a person to sit alongside said lateral sides without encountering said drawer.

8. An infant care apparatus as defined in claim 7 wherein said drawer moves away from said center position by sliding in either of two directions along a path at a right angle with respect to said lateral sides of said infant platform.

9. An infant care apparatus as defined in claim 7 wherein said base has a generally inwardly directed center section at both lateral sides of said infant care apparatus to enable a piece of furniture to be positioned beneath said infant care apparatus without encountering said base.

* * * * *